US005419473A

United States Patent [19]

Lamar

[11] Patent Number: 5,419,473

[45] Date of Patent: May 30, 1995

[54] GOLF BAG WITH LUMBAR SUPPORT

[76] Inventor: Kirk V. Lamar, 22011 Ventura Blvd., Ste. 200, Woodland Hills, Calif. 91364

[21] Appl. No.: 174,830

[22] Filed: Dec. 29, 1993

[51] Int. Cl.[6] ..... A45F 3/04

[52] U.S. Cl. ..... 224/215; 224/211; 206/315.3; 206/315.6; 206/315.7; 206/315.8

[58] Field of Search ..... 224/215, 209, 211, 210; 206/315.3, 315.5, 315.6, 315.7, 315.8

[56] References Cited

U.S. PATENT DOCUMENTS

| | | | |
|---|---|---|---|
| 1,570,500 | 1/1926 | Kennedy | 224/209 |
| 2,008,201 | 7/1935 | Chute . | |
| 2,853,111 | 9/1958 | Williams . | |
| 3,355,075 | 11/1967 | Dean . | |
| 4,074,839 | 2/1978 | Wood et al. . | |
| 4,182,470 | 1/1980 | Atkinson | 206/315.3 |
| 4,660,751 | 4/1987 | von Dewitz | 224/210 |
| 4,676,418 | 6/1987 | Lowe | 224/215 |
| 4,834,235 | 5/1989 | Ping . | |
| 4,982,883 | 1/1991 | Ullal et al. . | |
| 5,004,135 | 4/1991 | Dufournet et al. | 224/210 |
| 5,036,974 | 8/1991 | Ross, Jr. | 206/315.7 |
| 5,038,984 | 8/1991 | Izzo . | |
| 5,042,703 | 8/1991 | Izzo . | |
| 5,042,704 | 8/1991 | Izzo . | |
| 5,090,604 | 2/1992 | Howe . | |
| 5,125,507 | 6/1992 | Graziano, Jr. | 206/315.6 |
| 5,147,089 | 9/1992 | Anderson | 206/315.7 |
| 5,356,003 | 10/1994 | Gretz et al. | 206/315.7 |

FOREIGN PATENT DOCUMENTS

| | | | |
|---|---|---|---|
| 1722427 | 3/1992 | U.S.S.R. | 224/211 |

*Primary Examiner*—Linda J. Sholl
*Attorney, Agent, or Firm*—Snell & Wilmer

[57] ABSTRACT

A golf bag to be carried by a user for retaining golf clubs has an elongated tubular container, a shoulder strap system for carrying the container on the user's shoulder and a waist band system for fastening the container to the user's waist to support the weight of the container with the user's lower body. The waist band system including a waist band for fastening around the user's waist and a lumbar pad for providing cushioning to the user's lower back. The golf bag allows the user to transfer the weight of the bag from the shoulders to the lower back to ameliorate fatigue and soreness to the shoulders and to improve the golfer's posture and golf ability.

21 Claims, 3 Drawing Sheets

GOLF BAG WITH LUMBAR SUPPORT

BACKGROUND OF THE INVENTION

The present invention is directed generally to a sport and utility bag and, in particular embodiments, to a golf bag with a support structure designed to minimize user discomfort and fatigue and improve the user's posture.

The game of golf is not only one of the world's oldest presently practiced sports, but is also one of the most popular sports both on a recreational and professional level. In recent years, an increasing number of men and women have taken up the sport as a recreational activity. Moreover, the popularity of golf tournaments and competitions has also increased. With this increase in popularity of tile sport, there has also been an increase in interest in equipment and techniques for improving ones ability and enjoyment of the sport.

While much effort has been spent on the development of golf clubs and balls, many have failed to realize the impact that the golf bag has on ones ability and enjoyment of the sport. During a typical 18 hole golf game, a player may carry a bag full of golf clubs and other equipment for thousands of yards. It is no surprise that a common complaint among golfers relates to back, shoulder and neck pain caused by carrying heavy bags of golf equipment.

Moreover, the process of carrying such a bag a hundred yards or more, moments before lining up to swing at a golf ball, can severely affect the golfer's swing. Typical golf bags are designed with one or two shoulder straps such that the bag can be slung over one or both of the golfer's shoulders as the golfer walks from one ball position to the next. Such straps tend to concentrate the weight of the bag on either one or both shoulders. With a single shoulder strap, the weight of the golf bag is concentrated on one shoulder and offset relative to the golfer's spine, causing the golfer to shift his or her weight to the opposite side in order to balance the load.

Even with two shoulder straps, the weight of the golf bag on both shoulders tends to cause posture problems (e.g., hunching over of the shoulders) and discomfort. Furthermore, where most of the weight of the bag and equipment is concentrated on one or two shoulder straps, the straps tend to pinch nerves and possibly obstruct the circulation of blood in the shoulder area on which the strap is supported. This can result in numbness and loss of power and control in the golfers arms as well as fatigue to shoulder and arm muscles. These adverse affects can offset the golfer's swing posture, strain muscles and cause severe spine and hip discomfort. Posture being a very important component to ones golf swing form and golf ability, it is readily apparent that various prior golf bag designs have been a major contributor to many poor golf games and golf injuries.

A prior golf bag having a strap design to support the bag in a centered relationship relative to the user's bag is described in U.S. Pat. Nos. 5,038,984, 5,042,703 and 5,042,704, all to Izzo. This bag has two shoulder straps and a back pad, to allow the golfer to carry the bag's weight on both shoulders and to rest the bag, almost horizontally across the golfer's lower back. However, like the above discussed prior bag designs, the primary portion of the weight of the bag is carried on the golfer's shoulders. Moreover, the position of the bag when being carried tends to allow clubs or other equipment to fall out of the bag.

Thus, there is a need in the industry for a golf bag design which minimizes user discomfort and maximizes the user's golf posture. Therefore, it is an object of a preferred embodiment of the present invention to provide a new golf bag which addresses the above-discussed problems associated with prior golf bags and which can be easily carried over the distance of a typical golf course without causing undue fatigue or soreness to the user's shoulder, spine and hips.

SUMMARY OF THE DISCLOSURE

The present invention is directed generally to a sport and utility bag. Particular embodiments are directed to a golf bag structure and components thereof, including a support structure designed to minimize user discomfort and fatigue and improve the user's posture. The support structure comprises a shoulder strap system, waist band system and padding which, when working together, direct the primary portion of the weight of the golf bag to the users pelvis region. As a result, preferred embodiments of the present invention can ameliorate the fatigue, discomfort and posture problems associated with the use of various prior golf bag designs.

It is an object of embodiments of the present invention to provide a new and useful golf bag having a shoulder support system and a waist band and pad system wherein the weight of a golf bag may be supported primarily by the pelvis bones and lumbar region of the user.

A further object of embodiments of the present invention is to provide a retrofit strap and pad system for fitting to different types of styles of existing golf bags or which may be manufactured and sold in conjunction with a golf bag.

Yet another object of embodiments of the present invention is to provide an waist band system which may be employed as a retrofit system for any types of bags having a dual shoulder straps to transfer some of the weight of the golf bag from the shoulders to the lower back of the user.

The golf bag of preferred embodiments of the present invention comprises a container, a shoulder support system and a waist band system. The shoulder support system is coupled with the container for ballancing and stabalizing the container when the bag is carried by the user. In a preferred embodiment, the shoulder support system includes two shoulder straps which are adjustable in length to allow adjustment of the position of the container relative to the user's back.

The waist band system is also coupled with the container, for fastening the container to user's waist to support a portion or all of the weight of the container with user's lower body. The waist band system includes a waist band for fastening around the user's waist and a lumbar pad for providing cushioning to the user's lumbar or lower back region. In a preferred embodiment, the location of the waist band system is adjustable to fit different users and to allow the lumbar pad to be properly located relative to the size of the user, to effectively support a portion of the weight of the bag on the user's lower body, without discomfort or detrimental effects to the user's posture.

Because the golf bag is supported primarily by the lower body, the user does not experience the above-discussed detrimental fatigue or discomfort caused by using shoulder straps alone. In addition, because the waist band system is able to transfer some or all of the weight of the golf bag from the shoulders to the lower body of the user and because the transferred weight applies a pressure against the user's lower back, the bag directs the user to maintain his or her shoulders open (not hunched over) and his or her back relatively straight while carrying the bag in a centered, balanced manner. Because a strait back and open shoulder posture is important for the golf swing, carrying the bag can actually help the user train and improve the user's golf swing.

These and other objects of the present invention will become more readily appreciated and understood from a consideration of the following detailed description of the preferred embodiments when taken together with the accompanying drawings, in which:

DETAILED DESCRIPTION OF THE PREFERRED EMBODIMENT

Figure 1:
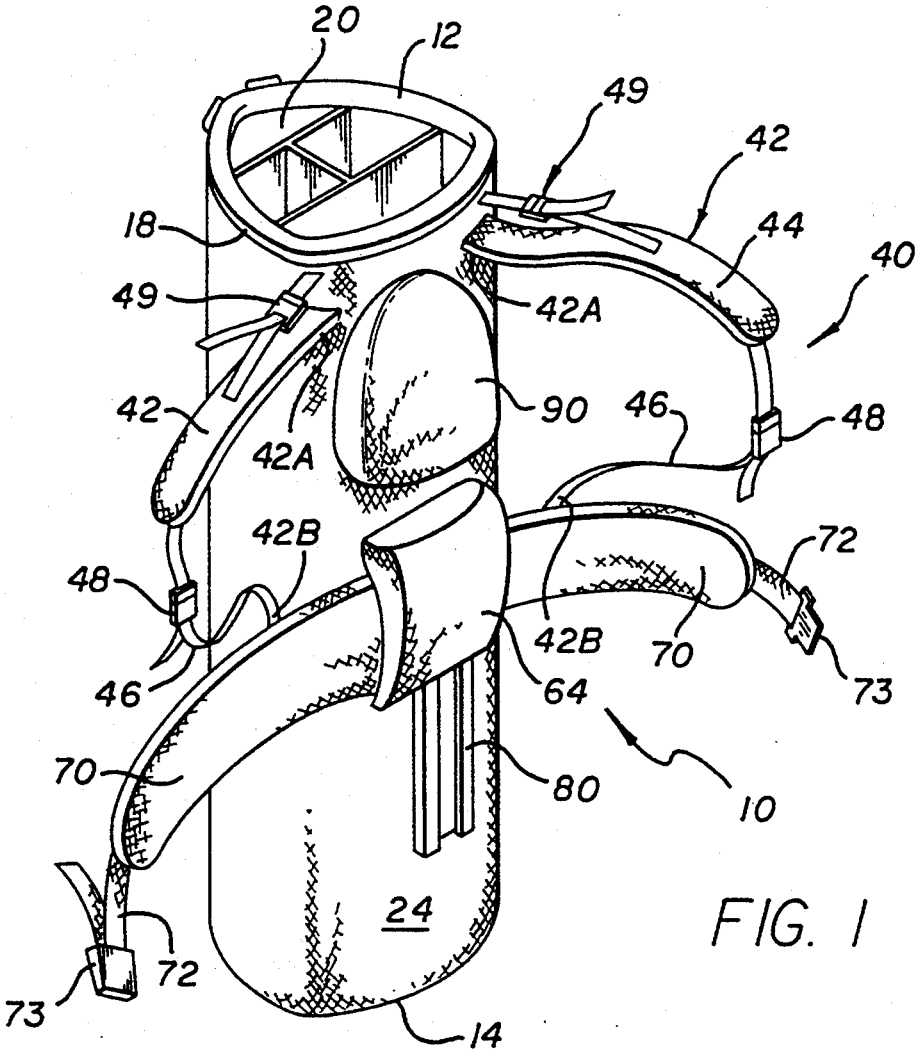
FIG. 1 is a perspective view of a golf bag according to an embodiment of the present invention.

The present invention is directed generally to a sport and utility bag. Particular embodiments are directed to a golf bag structure and components thereof, including a support structure designed to minimize user discomfort and fatigue and improve the user's posture. The support structure comprises a shoulder support system, waist band system and padding which distribute the weight of the golf bag from the user's shoulders to the lower back or lumbar region.

Embodiments of the present invention employ a shoulder support and waist band and padding assembly that may be manufactured as part of a golf bag or which may be manufactured separately as a retro-fit attachment to an existing golf bag. A waist band system according to embodiments of the invention may also be employed as a retrofit system for bags having an existing shoulder strap system, to transfer a portion or all of the weight of the golf bag from the user's shoulders to the user's lower body. In either case, preferred embodiments of the invention employ an elongated tubular container for retaining a plurality of golf clubs and golf accessories, a shoulder support system for retaining the bag in an upright orientation when carried by the user and a waist band system for fastening the bag to the user's waist and supporting a portion or all of the weight of the bag on the user's lower body, as well as for providing additional support for the user's abdomen wall and muscles.

A golf bag according to a preferred embodiment of the present invention is shown in FIGS. 1–6, wherein an elongated tubular container 10 has an open top end 12, a closed bottom end 14, and a sidewall 16 extending in a longitudinal direction and defining an open interior in which golf clubs and accessories may be stored. The top end has a rigid rim 18 and opens into an internal chamber 20, which is surrounded by the sidewall 16. The chamber 20 may be provided with internal walls or other separators for separating golf clubs (not shown) when stored therein. The bottom end 14 defines a rigid base. Preferably, the rigid rim 18 and the rigid base of the bottom end are made from a rigid plastic, while the sidewall 16 is made of a durable, yet light weight fabric. However, other suitable materials for these components may be used.

Figure 2:
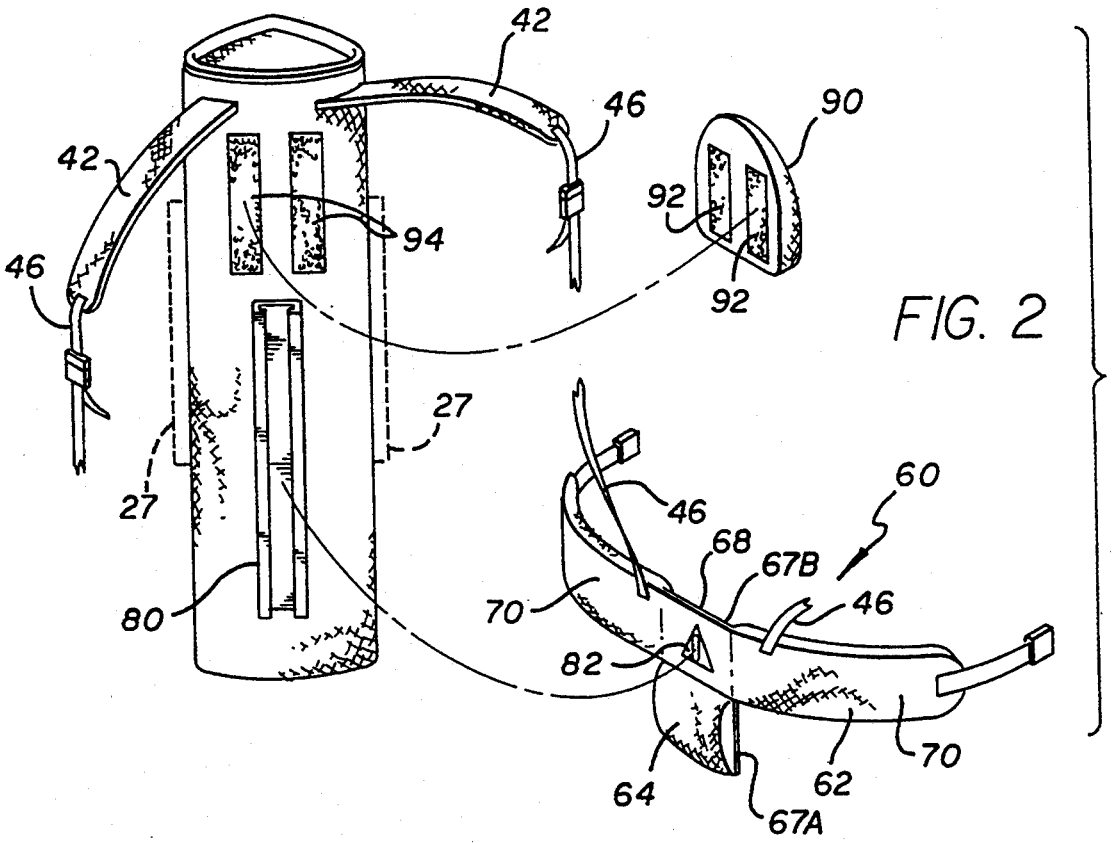
FIG. 2 is an exploded view of the golf bag of FIG. 1.
Figure 3:
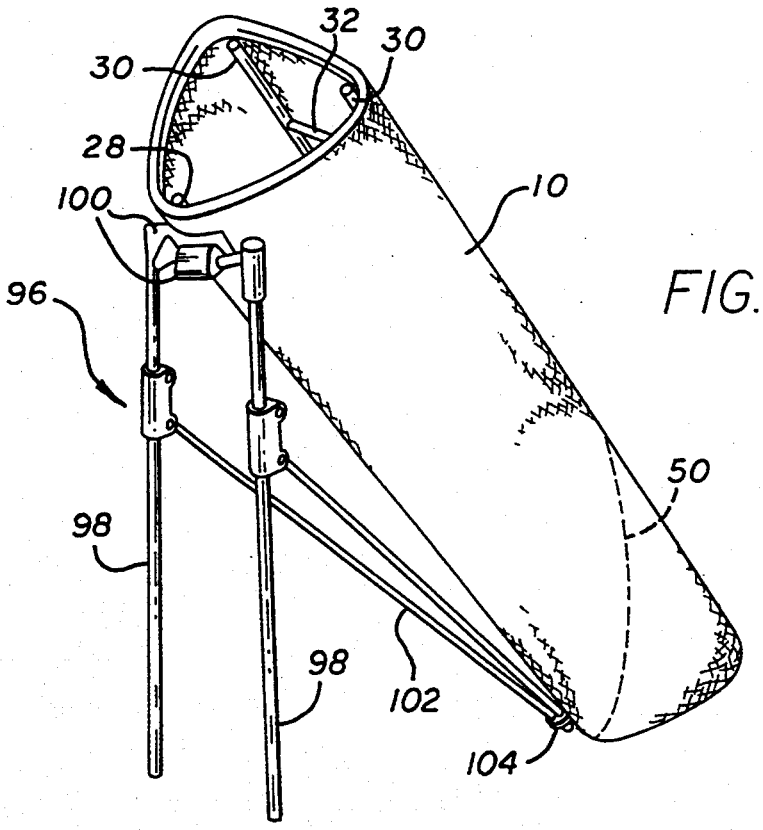
FIG. 3 is a further perspective view of the golf bag of FIG. 1.

The sidewall has a front side 24 and a substantially curved rear side (best shown in FIG. 3). In an alternative embodiment, the front side 24 of the sidewall 16 has a tapered lower section (shown in broken lines 50 in FIG. 3), which tapers towards and joins the rear side of the sidewall at the bottom end. This tapered arrangement prevents the bag from interfering with said user's legs when the user is walking and carrying the bag in a vertical orientation on his or her back. In further embodiments, the side wall 16 is provided with storage pockets 27 at various locations about the outer periphery of the bag, as shown in broken lines in FIG. 2.

In a preferred embodiment the sidewall 16 is made of a lightweight fabric material. To support the fabric sidewall in the longitudinal direction, a frame structure is provided between the rigid top rim 18 and the bottom base. The frame structure includes an elongated stiffening rod 28 (in FIG. 3) extending from the top rim top rim 18 to the base, at the rear side of the bag. The frame structure also includes two elongated parallel stiffening rods 30 extending between the top rim 18 and the base, at the front side of the bag. The rods 30 may be attached together by one or more stiffening cross rods 32 for further stability and support.

As best shown in FIGS. 1 and 2, a shoulder support system and a waist band system are coupled to the container 10. The shoulder support system comprises a system of straps 40 used for stabilization and maintaining the container 10 in an upright orientation when the bag is carried by the user. In preferred embodiments, the shoulder strap system 40 comprises a set of straps arranged so that the container 10 may be carried in a vertical orientation along the length of the user's back, while allowing a user to alternatively sling the bag over one shoulder for short distance walks.

The shoulder strap system 40 includes two shoulder straps 42, each having a first end coupled to the container 10 at or adjacent to the upper rim 18 and a second end coupled to the waist band system as described below. Each strap has a padded upper end portion 44 which is positioned to rest on a user's shoulder. The lower end 46 of each strap 42 is connected to the waist band system through an adjustment mechanism, preferably a quick release adjustment mechanism, so that the length of the straps is easily adjustable by the user.

The adjustment mechanism may be, for example, an adjustable buckle 48 of well known construction. In a preferred embodiment, additional quick release and adjustment mechanisms are used to connect each strap 42 with the top end of the container. Such additional mechanisms may include a strap and buckle arrangement 49 connected between the center portion of each padded strap end 44 and the upper end of the container 10, as shown in FIG. 1. The quick release and adjustment mechanisms are preferably positioned to be easily accessed and operated, so that the user can quickly and easily adjust the position of the container relative to his or her back (e.g., by merely tugging on the loose end of a strap portion at the buckle), while the container is supported on the user's back and shoulders in the carrying position.

The waist band system 60 includes a waist band 62 and a lumbar pad 64 for fastening the container 10 to user's waist. Since the container is attached to the user not only by the shoulder straps but also the waist band system, a portion or all of the container's weight can be supported by the user's lower body. This will greatly ameliorate shoulder strain and other adverse affects of supporting virtually all of the bag's weight with the shoulders. In addition, the waist band effects a distribution of the weight of the golf bag from the shoulders and to the lower body, such that the user is able to readily maintain his or her balance and keep his or her shoulders open and back straight while carrying the bag in a centered, balanced manner.

The waist band 62 has a central portion 68 for receiving the lumbar pad and two opposite laterally extending portions 70. Alternatively, one laterally extending portion may be used, as long as it is provided with a sufficient length to extend from one side of the central portion 68, around the user's waist to another side of the central portion. Each lateral portion 70 is widened and padded for additional comfort and support, when strapped about the user's waist. In preferred embodiments, the lower end portion 46 of each shoulder strap 42 is connected to one of the lateral portions 70 of the waist band, through a quick release and adjustment mechanism of the type noted above.

Extending from the free end of each lateral portion 70 further is an elongated belt 72 and clasp mechanism 73 for fastening the lateral portions 70 around said user's waist. The belt can also be connected around the rear side of the container 10, when not in use. Preferably, the clasp mechanism is provided with an adjustment mechanism for adjusting the length of the belt 72. Such clasps, with adjusting mechanisms are well known and commonly used, e.g., in for vehicle seat belts or the like.

Preferably, the lateral portions 70 of the waist band are of a suitable width such that, when sufficiently tightened about the user's waist, the lateral portions 70 press against the user's abdomen so as to provide additional abdominal wall and muscle support. In further embodiments, the lateral portions 70 and/or the lumbar pad 64 are provided with one or more internal, inflatable bladders coupled to a mechaniclly operated pump (such as a hand squeeze pump) for allowing the user to adjust the pressure applied by the waist band to the abdominal area or to generally adjust the tightness of the waist band. Such inflateable bladders are commonly used in other devices, such as arm straps for blood pressure monitor systems, sports shoes, and the like.

In preferred embodiments, the waist band system 60 is coupled to the container 10 so as to be adjustable in position along the length of the container. The ability to adjust the location of the waist band system along the longitudinal direction of the container is provided so that the waist band system can be readily located at the lumbar area of users of various sizes.

In a preferred embodiment, the adjustable attaching means is a rail and slider arrangement, comprising an elongated, channeled rail 80 coupled to the front side of the wall 16, in the longitudinal direction of the container, and a slider 82 coupled to the pad portion 68 for slidable engaging the channeled rail. The rail defines a channel formed by "L"-shaped side walls oriented along the length of the container 10. The rail may be formed of any suitable material, including metal, plastic, rigid rubber-like material, or the like.

Figure 4:
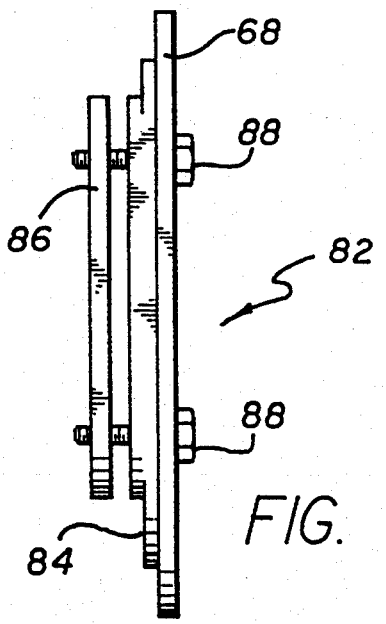
FIG. 4 is a side view of a slider structure such as employed with the FIG. 1 embodiment.
Figure 5:
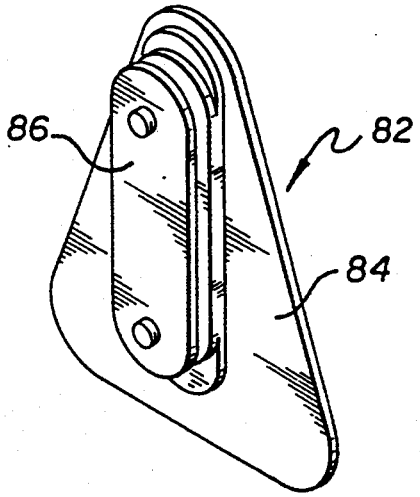
FIG. 5 is a perspective view of the slider shown in FIG. 4.

The slider 82, as best shown in FIGS. 4 and 5, comprises a base 84 and a channel riding member 86 coupled to and spaced from the base by threaded bolts 88. The channel riding member 86 is configured to fit within and slide relative to the channel, yet be retained by the "U"-shaped walls of the rail 80.

In operation, the user may move the slider 82 (and waist band system 60 coupled thereto) along the length of the rail 80 to a desired position. Then the user may tighten the bolts 88 so as to draw the base 84 and channel riding member 86 together with a portion of the "L"-shaped rail walls interposed therebetween. By so tightening, the slider 82 may be locked in position (e.g., fixed to the rail 80). Preferably, the heads of the bolts 88 are exposed within the central portion 68 of the waist band 62 so as to allow the user to loosen and retighten the bolts for adjusting the position of the waist band system. In order to further strengthen the container wall to which the rail is coupled, a stiffening material (such as a planar sheet of plastic, or other suitable material) may be provided within the container wall or positioned internal or external to the container wall and fixed thereto.

While a rail and slider arrangement are preferred, other alternative embodiments of the adjustable attachment means can also be used, such as, hook and loop fastening means (VELCRO, a trademark), snap fastening means, slot and tab fastening means and any other fastening means which are well known in the art, arranged along the length of the front side of wall 16.

The lumbar pad 64 may be hingeably attached to the central portion 68 of the waist band 62, such that the lumber pad 64 can be pivoted to an open position (FIG. 2) so that the user can gain access to the adjustable attaching means (e.g., bolts 88) for adjusting the attachment location of the waist band or for removal of the waist band from the container. In an alternative embodiment, the lumber pad 64 is totally detachable from the waist band system (e.g., with the use of any suitable attaching means, such as hook and loop fastening material, snap fasteners, zipper fasteners, tab and slot fasteners or the like) for allowing access to the adjustable attaching means.

During use, the lumbar pad 64 is coupled to the central portion of the waist band in a closed position, such that the adjustable attaching means (e.g., bolts 88) is concealed between the pad and the central portion 68. The lumbar pad is arranged to be positioned at the lower back or lumbar region of the user, when the golf bag is carried by the user. The lumbar pad provides a pressure and cushioning to the user's lower back to assist in maintaining the user's proper posture and to help distribute the weight of the bag to the user's lower body region, as discussed above.

In a preferred embodiment, a hook and loop fastening means is used to couple the lumbar pad in the closed position (as shown in FIG. 1) to the central portion of the waist band system. Alternative releasable coupling means to such hook and loop fastening material, such as snap fasteners, zipper fasteners, tab and slot fasteners or the like may be used.

In a further embodiment, an upper back pad 90 may be coupled to the upper portion of the front side of the sidewall 16 for providing cushioning to the user's upper back. Preferably, the upper back pad 90 is coupled to the front side by a hook and loop means 92, 94, although other coupling means available in the art (discussed above) may be used.

While the above-discussed embodiments provide for a golf bag having a strap and pad system, alternative embodiments of the strap and pad system can be manufactured alone and used in conjunction with an existing golf bag. In this regard, the straps and pads discussed above with respect to FIGS. 1 and 2 may be individually affixable to an existing golf bag or, alternatively, may be affixed to a support base which is, in turn, affixed to an existing golf bag.

In a further preferred embodiment of the present invention, a supporting system 96 is provided to allow the container 10 to stand freely, as shown in FIG. 3. Various embodiments of a support system may be used for this purpose. However, a preferred supporting system 96, as shown in FIG. 3, includes two elongated thin supporting rods 98 pivotally coupled to the upper end of the container 10, via pivot links 100. A semiflexible rod 102 extends from a central location on one supporting rod 98, through a guide 104, loops around the guide 104 and extends to a central location of the other supporting rod 98. Preferably, the semiflexible rod 102 has an internal spring energy, urging it into a straight orientation. The spring force tends to force the supporting rods 98 into one of two positions, including a first position as shown in FIG. 3, and a second position in which the rods 98 extend substantially parallel with the length of the container 10. When in the second position, a portion of the loop formed by the semiflexible rod 102 extends below the guide 104 and below the bottom of the container 10. In this regard, when the bottom of the container 10 is set on the ground, the looped portion of the semiflexible rod 102 is pushed upward toward the guide 104, forcing the supporting rods 98 into the extended position shown in FIG. 3.

Figure 6:
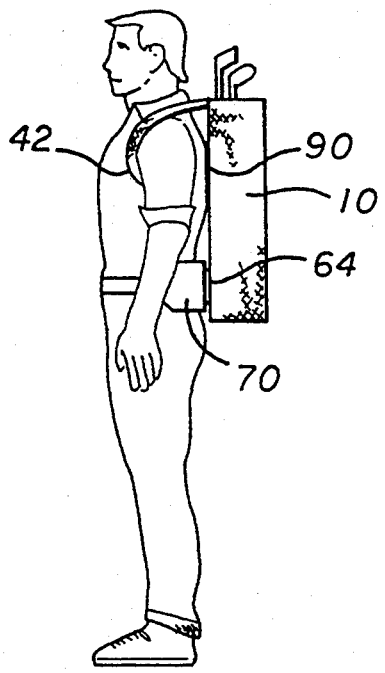
FIG. 6 is a side view of a user carrying a golf bag according to the FIG. 1 embodiment.
Figure 7:
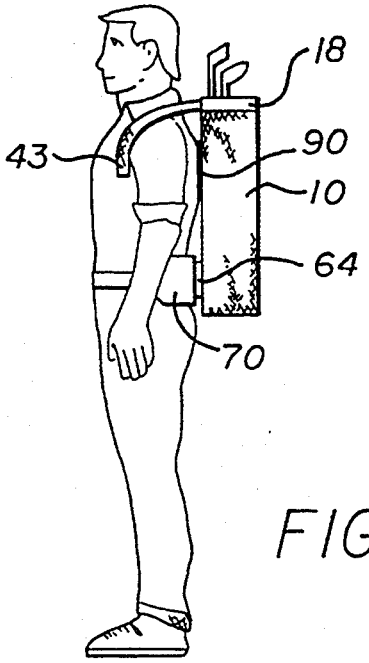
FIG. 7 is a side view of a user carrying a golf bag according to another embodiment of the present invention.

FIG. 6 shows a user carrying the golf bag discussed above with respect to FIG. 1, wherein the shoulder straps 42 are disposed over the user's shoulders and the lateral portions 70 of the waist band are disposed about the user's waist. A further golf bag embodiment is shown in FIG. 7, wherein the shoulder support system comprises a pair of rigid or semirigid shoulder rests 43, instead of the shoulder straps 42. Other structure in the FIG. 7 golf bag is similar to that of the FIG. 1 golf bag.

Each shoulder rest 43 comprises an elongated member which is curved to approximate the curvature of a user's shoulder, so that each elongated member extends over a respective one of the user's shoulders towards the user's chest, as shown in FIG. 7. The shoulder contacting surface of each elongated member may be provided with padding for additional user comfort. In preferred embodiments, the elongated members of the shoulder rest 43 and the top rim 18 of the container are formed as a single unitary structure, e.g., molded out of sufficiently high strength plastic. However, in other embodiments, the elongated members may be formed as separate structures, attachable to the top rim 18 or to other locations on the container.

The invention may be embodied in other specific forms without departing from the spirit or central characteristics thereof. The present specification is therefore to be considered in all respects as illustrative and not restrictive, the scope of the invention being indicated by the appended claims rather than by the foregoing description, and all changes which come within the meaning and range of equivalency of the claims are to be embraced therein.

What is claimed is:

1. A golf bag to be carried by a user for retaining golf clubs, comprising:

a. an elongated tubular container having an open end, an opposite end, and a sidewall extended in a longitudinal direction, where the open ends opens into an internal chamber of the sidewall for retaining said golf clubs;

b. a shoulder support system coupled with said container for stabilizing said container with at least one of said user's shoulders;

c. a waist band system coupled to said container to support at least a portion of the weight of said container with said user's lower body, the waist band system including a waist band for fastening around said user's waist and a lumber pad for providing cushioning to said user's lower back d. said waist band has a pad portion and two opposite laterally extending portions;

e. means for adjustably attaching said pad portion of said waist band to said sidewall of said container for adjusting the location on the container at which the waist band is attached;

f. said lumber pad is hingedly attached to said pad portion of said waist band, at least a portion of said means for adjustably attaching positioned behind said lumber pad such that said lumber pad can be pivoted to an open position to gain access to said adjustable attaching means for adjusting said attachment location of said waist band.

2. A golf bag of claim 1, wherein said shoulder support system comprises two shoulder straps each having an upper end connected to said container and a lower end connected to said waist band system through an adjustment mechanism for adjusting the strap length.

3. A golf bag of claim 2, wherein said shoulder strap is further connected to said open end of said container through an adjustment mechanism for adjusting the position of the container relative to the user's back for stabilizing keeping said container when carried by the user.

4. A golf bag of claim 3, wherein said adjustment mechanism is a quick release and adjustment mechanism.

5. A golf bag of claim 2, wherein said shoulder straps are padded such that the weight placed on the shoulders can be more evenly distributed.

6. A golf bag of claim 1, wherein each of said lateral portions is padded, and each of said lateral portions having an elongated belt for fastening around said user's waist.

7. A golf bag of claim 6 wherein said elongated belt further comprising an adjustable clasp.

8. A golf bag of claim 1, wherein the location of said waist band system is adjustable along said longitudinal direction of the bag.

9. A golf bag of claim 8, wherein said adjustable attaching means comprises a channeled rail affixed to said sidewall along said longitudinal direction and at least one slidable member coupled to said pad portion of said waist band and slidable along the channeled rail.

10. A golf bag of claim 1 further comprising an upper back pad coupled to said container to cushion the user's upper back.

11. A golf bag of claim 1 further comprising a supporting frame for stiffening said sidewall of said container.

12. A golf bag of claim 1 further comprising a support stand composed of two elongated supporting rods each having an upper end pivotally connected to said sidewall of said container at a location spaced apart from said opposite end of said container, such that when said container is set on said opposite end of said container, the two supporting rods can be pivoted relative to said container to form a tripod with said opposite end.

13. A golf bag of claim 12 wherein said supporting stand further comprising two thin supplemental rods each having an upper end and a lower end, the lower ends integrally connected together and slidable engaged with a said bottom end edge of said container, and said upper ends pivoted onto said two supporting rods respectively, such that when said container is carried by the user and said two supporting rods rest in parallel with said container, the lower end of said two supplemental rods slide downwardly and also rest in parallel with said container, but when said container is placed on the ground surface, said supplemental support rods is pushed to slide out to provide supplemental support to the two supporting rods respectively and as the result, the supporting rods is propped out for supporting the container in the standing position.

14. A golf bag to be carried by a user for retaining a plurality of golf clubs and golf accessories, the golf bag comprising:

a. an elongated tubular container having an open top end, an opposite bottom end, and a sidewall extended in a longitudinal direction, the top end having a rigid rim and opened into an internal chamber, the sidewall having a substantially flat front side and a substantially curved rear side, and the bottom end having a rigid base defining an edge;

b. a shoulder strap system for balancing said container in a vertical orientation, including two shoulder straps each having an upper end connected to said container at a location adjacent to said top end of said container and a lower end;

c. a waist band system having a waist band and a lumbar pad for fastening said container to said user's waist to support the weight of said container with said user's lower body;

d. said waist band having a middle portion and two opposite laterally extending portions, said lower end of each shoulder straps connected to said waist band through an adjustment mechanism; and e. means for adjustably attaching said middle portion of said waist band to said substantially flat front side of said sidewall of said container but adjustable along said longitudinal direction;

f. said lumbar pad hingeably attached to said middle portion of said waist band, such that said lumbar pad can be pivoted to an open position to gain access to said adjustable attaching means for adjusting said attachment location of said waist band.

15. A golf bag of claim 14 wherein said front side of said sidewall of said container has an inclined lower section tapered towards and joining said rear side of said sidewall at said bottom end for preventing interference with said user's legs when said user is walking.

16. A golf bag of claim 14 further comprising a partitioning member disposed inside said internal chamber for dividing said chamber into a plurality of elongated compartments for retaining said plurality of golf clubs separately.

17. A golf bag of claim 14 further comprising a plurality of external pockets disposed on said sidewall.

18. A golf bag as defined in claim 14 wherein said lower end of each shoulder strap is coupled to said waist band.

19. A golf bag of claim 14 wherein said waist band comprises an inflatable bladder.

20. A golf bag of claim 14 wherein said adjustable attaching means comprises a channeled rail affixed to said front side of said sidewall along said longitudinal direction, and a slidable member coupled to said middle portion of said waist band and slidable along the channeled rail.

21. A golf bag of claim 14 further comprising an upper back pad coupled to an upper portion of said front side of said sidewall for providing cushioning to said user's upper back.

* * * * *